US011879648B2

(12) United States Patent
Shimomugi et al.

(10) Patent No.: US 11,879,648 B2
(45) Date of Patent: Jan. 23, 2024

(54) OUTDOOR MACHINE AND AIR CONDITIONER

(71) Applicant: Mitsubishi Electric Corporation, Tokyo (JP)

(72) Inventors: Takuya Shimomugi, Tokyo (JP); Keisuke Mori, Tokyo (JP); Koichi Arisawa, Tokyo (JP); Takashi Yamakawa, Tokyo (JP); Kenji Iwazaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 807 days.

(21) Appl. No.: 16/965,346

(22) PCT Filed: Feb. 5, 2018

(86) PCT No.: PCT/JP2018/003764
§ 371 (c)(1),
(2) Date: Jul. 28, 2020

(87) PCT Pub. No.: WO2019/150577
PCT Pub. Date: Aug. 8, 2019

(65) Prior Publication Data

US 2021/0123612 A1 Apr. 29, 2021

(51) Int. Cl.
*F24F 1/24* (2011.01)
*F24F 1/22* (2011.01)
(Continued)

(52) U.S. Cl.
CPC ..... *F24F 1/24* (2013.01); *F24F 1/22* (2013.01); *F24F 1/38* (2013.01); *F24F 1/48* (2013.01);
(Continued)

(58) Field of Classification Search
CPC ..... F24F 1/22; F24F 1/24; F24F 1/38; F24F 1/48; F24F 1/56; F24F 13/08; F24F 13/20
See application file for complete search history.

(56) References Cited

U.S. PATENT DOCUMENTS 4,813,345 A * 3/1989 Kobayashi ..... F24F 13/20 62/263
2004/0129087 A1* 7/2004 Rowe ..... G01R 33/09 73/777
(Continued)

FOREIGN PATENT DOCUMENTS

EP 2 241 830 A2 10/2010
JP 2000-161717 A 6/2000
(Continued)

OTHER PUBLICATIONS

Japanese Office Action dated Mar. 25, 2021, issued in corresponding Japanese Patent Application No. 2019-568542 (and English Machine Translation).
(Continued)

*Primary Examiner* — Henry T Crenshaw
(74) *Attorney, Agent, or Firm* — POSZ LAW GROUP, PLC

(57) ABSTRACT

An outdoor machine includes a housing including a front panel with an opening formed therein; a blower disposed in the housing; a bell mouth disposed in the outer periphery of the blower and connected to the opening; a control board on which an electric component is mounted, the control board being provided in the housing; a heat radiation part that radiates heat generated by the electric component; and a vent deflector that covers the heat radiation part, and forms a ventilation flue through which air generated by the blower flows in the heat radiation part, in which the vent deflector 20 is not provided in a region between a virtual plane S and
(Continued)

the front panel, the virtual plane S covering the entire periphery of an edge of the bell mouth and extending in parallel with the front panel.

9 Claims, 7 Drawing Sheets

(51) Int. Cl.

| | |
|---|---|
| ***F24F 1/38*** | (2011.01) |
| ***F24F 1/48*** | (2011.01) |
| ***F24F 1/56*** | (2011.01) |
| ***F24F 13/08*** | (2006.01) |
| ***F24F 13/20*** | (2006.01) |

(52) U.S. Cl.
CPC ..... *F24F 1/56* (2013.01); *F24F 13/08* (2013.01); *F24F 13/20* (2013.01)

(56) References Cited

U.S. PATENT DOCUMENTS

2007/0006610 A1* 1/2007 Kawasaki ..... F24F 1/46 62/298
2010/0294466 A1* 11/2010 Shimaoka ..... F24F 1/54 165/104.33
2014/0299298 A1* 10/2014 Kono ..... F24F 1/40 165/121
2015/0319885 A1* 11/2015 Uehara ..... F24F 1/18 361/700

FOREIGN PATENT DOCUMENTS

| | | | |
|---|---|---|---|
| JP | 2007-085649 | A | 4/2007 |
| JP | 2007-093116 | A | 4/2007 |
| JP | 2009-299907 | A | 12/2009 |
| JP | 2010-236781 | A | 10/2010 |
| JP | 2010-270944 | A | 12/2010 |
| JP | 2013-064539 | A | 4/2013 |
| JP | 2015-048990 | A | 3/2015 |

OTHER PUBLICATIONS

Chinese Office Action dated Apr. 2, 2021, issued in corresponding Chinese Patent Application No. 201880088196.0 (and English Machine Translation).
Office Action dated Aug. 31, 2021, issued in corresponding Indian Patent Application No. 202027032546.
International Search Report of the International Searching Authority dated May 1, 2018 for the corresponding International application No. PCT/JP2018/003764 (and English translation).

* cited by examiner

OUTDOOR MACHINE AND AIR CONDITIONER

CROSS-REFERENCE TO RELATED APPLICATION

This application is a U.S. national stage application of International Patent Application No. PCT/JP2018/003764 filed on Feb. 5, 2018, the disclosure of which is incorporated herein by reference.

TECHNICAL FIELD

The present invention relates to an outdoor machine and an air conditioner.

BACKGROUND

An outdoor machine to be used for a conventional air conditioner or the like includes therein a control board and a heat radiation part. The control board controls the operation of a compressor, a blower, and the like. The heat radiation part is for radiating heat generated by an electric component mounted on the control board. The heat radiation part includes a base connected to the control board and a plurality of fins extending from the base. Furthermore, there are cases where a heat radiation part includes an air guide that is provided on the end side of the plurality of fins to form a ventilation flue surrounded by the base, the plurality of fins, and the air guide such that air flows through the ventilation flue to efficiently cool the entire heat radiation part (for example, Patent Literature 1).

PATENT LITERATURE

Patent Literature 1: Japanese Patent Application Laid-open No. 2009-299907

In an outdoor machine including a bell mouth provided at an outlet formed in a front panel, a heat radiation part is disposed adjacent to the front panel and the bell mouth in a space in which a blower is disposed. Accordingly, a closed space is formed by the leeward end of the heat radiation part, a partition plate, the front panel, and the bell mouth. The partition plate divides a space inside the outdoor machine into a space in which a compressor is disposed and the space in which the blower is disposed. Thus, air stagnation (high-pressure portion) occurs on the leeward side of the heat radiation part. As a result, there has been a problem in that even if the air guide is provided, sufficient air does not flow through the ventilation flue, so that the cooling capacity of the heat radiation part cannot be obtained sufficiently.

SUMMARY

The present invention has been made to solve the above-described problem, and an object of the present invention is to provide an outdoor machine that improves the cooling capacity of a heat radiation part.

An outdoor machine according to the present invention includes: a housing that includes a front panel in which an outlet is formed, a blower disposed in the housing, a bell mouth disposed in an outer periphery of the blower and connected to the outlet; a control board on which an electric component is mounted, the control board being provided in the housing, a heat radiation part that radiates heat generated by the electric component; and vent deflector that covers the heat radiation part, and forms a ventilation flue through which air generated by the blower flows in the heat radiation part. The vent deflector is not provided in a region between a virtual plane and the front panel, and the virtual plane covers an entire periphery of an edge of the bell mouth and extends in parallel with the front panel.

In an outdoor machine according to the present invention, the outlet of a ventilation flue formed by a heat radiation part and a vent deflector is located on the windward side with respect to a bell mouth. Therefore, the ventilation flue is opened in a space where air stagnation is less likely to occur and pressure loss is low. Thus, air can easily flow through the ventilation flue. As a result, the flow velocity of air flowing through the ventilation flue is increased, so that the cooling capacity of the heat radiation part can be improved.

DETAILED DESCRIPTION

Figure 1:
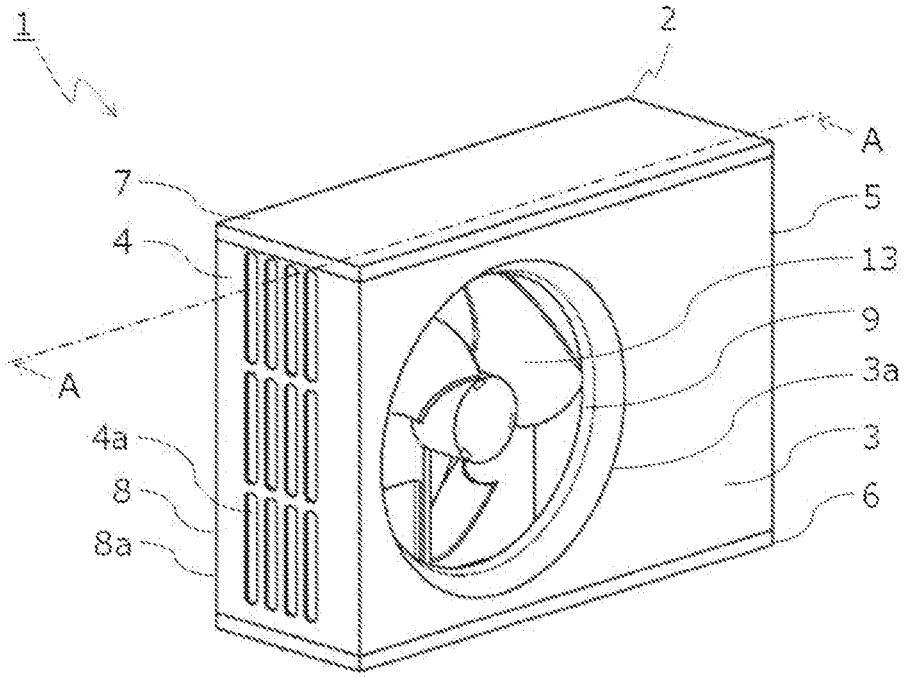
FIG. 1 is a perspective view of an example of an outdoor machine according to a first embodiment of the present invention.

Hereinafter, embodiments of the present invention will be described with reference to the drawings. In the following drawings, the same or corresponding parts are denoted by the same reference numerals, and description thereof will not be repeated. Note that arrows in the drawings indicate directions of air flow. Furthermore, in the following drawings including FIG. 1, there are cases where the relationship of size between each constituent member is different from the actual one. In addition, the forms of constituent elements set forth in the entire specification are merely examples, and the present invention is not limited to these descriptions.

First Embodiment

Figure 2:
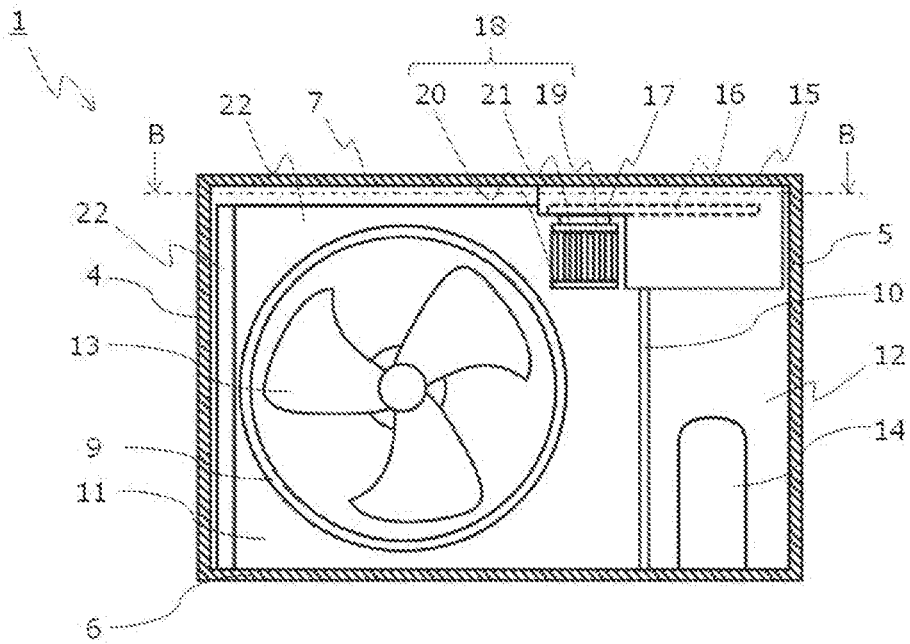
FIG. 2 is a cross-sectional view of the outdoor machine according to the first embodiment of the present invention, taken along line A-A in FIG. 1.
Figure 3:
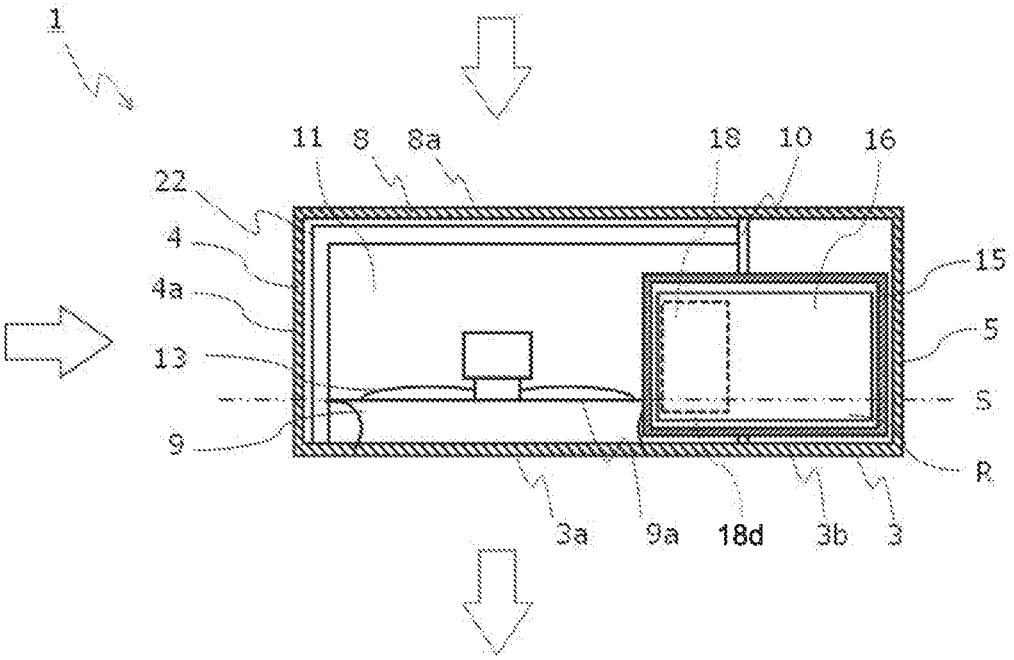
FIG. 3 is a cross-sectional view of the outdoor machine according to the first embodiment of the present invention, taken along line B-B in FIG. 2.

A schematic configuration of an outdoor machine according to a first embodiment of the present invention will be described with reference to FIGS. 1 to 3. FIG. 1 illustrates a perspective view of the outdoor machine. FIG. 2 is a cross-sectional view taken along line A-A of FIG. 1, and illustrates an outdoor machine 1 from which a front panel 3 has been removed. FIG. 3 is a B-B cross-sectional view of the outdoor machine 1 illustrated in FIG. 2, and illustrates the outdoor machine 1 to which the front panel 3 has been attached for convenience of description.

The outdoor machine 1 is applied to, for example, an air conditioner, and includes a housing 2, a heat exchanger 22, a compressor 14, a blower 13, and an electric component box 15. The housing 2 forms an outer shell. The heat exchanger 22, the compressor 14, the blower 13, and the electric component box 15 are provided in the housing 2.

The housing 2 includes the front panel 3, a rear panel 8, a left side panel 4, a right side panel 5, a bottom panel 6, and a top panel 7. The front panel 3 forms the front surface of the housing 2. The rear panel 8 faces the front panel 3, and forms the back surface of the housing 2. The left side panel 4 forms the left side surface of the housing 2 when the housing 2 is viewed from the front. The right side panel 5 faces the left side panel 4, and forms the right side surface of the housing 2 when the housing 2 is viewed from the front. The bottom panel 6 forms the bottom surface of the housing 2. The top panel 7 faces the bottom panel 6, and forms the top surface of the housing 2. Note that the front panel 3 and the left side panel 4 may be integrally formed with a single part.

A circular opening 3*a* is formed in the front panel 3. An opening 4*a* is formed in the left side panel 4. An opening 8*a* is formed in the rear panel 8. The openings 4*a* and 8*a* are for taking in air from the outside to the inside of the housing 2. The opening 3*a* is for discharging air from the inside of the housing 2 to the outside, and is an air outlet.

A bell mouth 9 is provided at the opening 3*a* of the front panel 3. The bell mouth 9 has an annular shape, and protrudes from the peripheral edge of the opening 3*a* into the housing 2. An edge 9*a* of the bell mouth 9 protruding into the housing 2 protrudes in parallel with the front panel 3 when viewed from above. The blower 13 is provided inside the bell mouth 9. The bell mouth 9 has an annular shape along the rotation direction of the blower 13 in such a way as to surround the outer periphery of the blower 13, and aligns the flow of air generated by the blower 13. Note that the front panel 3 corresponds to a panel in the present invention.

The heat exchanger 22 includes a plurality of stacked fins and a heat transfer tube that penetrates the fins. The heat exchanger 22 performs heat exchange between a refrigerant passing through the heat transfer tube and the air. The heat exchanger 22 is bent in an L-shape when viewed from above, and is disposed along the rear panel 8 and the left side panel 4. The compressor 14 is a device that compresses and discharges the refrigerant, and is disposed in a machine chamber 12 to be described below.

The blower 13 is disposed between the front panel 3 and the rear panel 8. The blower 13 faces the opening 3*a*. The blower 13 is a blowing means that includes, for example, a propeller fan and a fan motor. The blower 13 generates an airflow from the opening 8*a* of the rear panel 8 and the opening 4*a* of the left side panel 4 to the opening 3*a* of the front panel 3, so that air circulation is generated for efficient heat exchange in the heat exchanger 22. Furthermore, the compressor 14 and a refrigerant pipe (not illustrated) connected to the compressor 14 are provided in the machine chamber 12.

A partition plate 10 divides the inside of the housing 2 of the outdoor machine 1 into a blower chamber 11 and the machine chamber 12. The blower chamber 11 is a space formed by the front panel 3, the left side panel 4, the bottom panel 6, the top panel 7, the rear panel 8, and the partition plate 10. The machine chamber 12 is a space formed by the front panel 3, the right side panel 5, the bottom panel 6, the top panel 7, the rear panel 8, and the partition plate 10. The opening 3*a*, the opening 4*a*, and the opening 8*a* are formed in positions where the opening 3*a*, the opening 4*a*, and the opening 8*a* face the blower chamber 11.

The electric component box 15 is for controlling the components of the air conditioner, and is disposed above the partition plate 10 in such a way as to straddle the blower chamber 11 and the machine chamber 12. The electric component box 15 accommodates a control board 16 with an electric component 17 attached thereto. A heat radiation part 18 that radiates heat generated by the electric component 17 is attached to the electric component 17. In addition, a part of the heat radiation part 18 is covered with a vent deflector 20.

The electric component 17 is for controlling the components of the air conditioner, and includes, for example, a semiconductor element. In the case where AC power is input, the control board 16 includes a converter unit and an inverter unit that operate as follows. The converter unit converts AC power into DC power. The inverter unit converts DC power into AC power to drive a compressor motor of the compressor 14 or the fan motor of the blower 13.

The converter unit includes, for example, a diode bridge module for rectification, a switching element for causing DC voltage to be variable when AC power is converted into DC power, or a backflow prevention element for preventing current backflow to a power source side due to the boosting of the DC voltage. The inverter unit includes, for example, an inverter module including six switching elements. Note that the types of semiconductor element are not limited thereto, and may be determined according to a circuit configuration.

As illustrated in FIG. 2, the heat radiation part 18 is disposed below the control board 16. In the blower chamber 11, the heat radiation part 18 is disposed on the blower chamber 11 side of the control board 16. When viewed from the front, the heat radiation part 18 is located outside the edge 9*a* of the bell mouth 9 such that there is no overlap between the heat radiation part 18 and the bell mouth 9. The heat radiation part 18 is provided in contact with the electric component 17. The heat radiation part 18 is for cooling the electric component 17 attached to the control board 16.

The lower part of the heat radiation part 18 is covered with the vent deflector 20, so that a space surrounded by the heat radiation part 18 and the vent deflector 20 is formed as a ventilation flue 23. As illustrated in FIG. 3, wind generated by the blower 13 flows from the rear panel 8 toward the front panel 3. Thus, the wind also flows through the ventilation flues 23 of the heat radiation part 18 from the rear panel 8 side toward the front panel 3 side.

When viewed from above, the heat radiation part 18 is disposed closer to the front panel 3 than to the rear panel 8 such that a leeward end portion 18*d* facing the front panel 3 side is located adjacent to the front panel 3 and the bell mouth 9. Specifically, assume that a virtual plane S is defined as a virtual plane that extends in parallel with an inner surface 3*b* of the front panel 3 and covers the entire periphery of the edge 9*a* of the bell mouth 9 in such a way as to close the bell mouth 9, and that a region R is defined as a region between the virtual plane S and the front panel 3. Then, the leeward end portion 18*d* of the heat radiation part 18 is located in the region R.

Next, the configuration of the heat radiation part 18 will be described with reference to FIGS. 4 to 6. Hereinafter, an X direction is defined as a direction from the right side panel 5 to the left side panel 4, a Y direction is defined as a direction from the rear panel 8 to the front panel 3, and a Z direction is defined as a direction from the top panel 7 to the bottom panel 6. In addition, the rear panel 8 side is referred to as a windward side, and the front panel 3 side is referred to as a leeward side.

Figure 4:
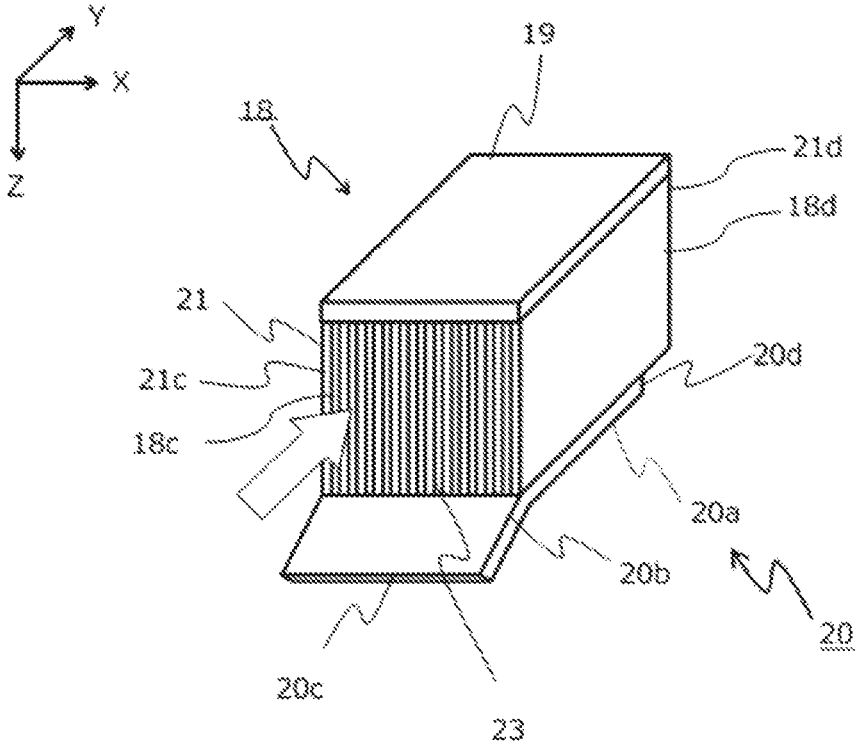
FIG. 4 is a perspective view of a heat radiation part of the outdoor machine according to the first embodiment of the present invention.

FIG. 4 illustrates a perspective view of the heat radiation part 18 and the vent deflector 20 viewed from the rear panel 8 side of the outdoor machine 1. FIG. 5 illustrates a side view of the heat radiation part 18 viewed from the left side panel 4 side of the outdoor machine 1, and also illustrates the front panel 3, the bell mouth 9, and the rear panel 8 together therewith for convenience of description. FIG. 6 illustrates a bottom view of the heat radiation part 18 viewed from the bottom panel 6 side of the outdoor machine 1.

As illustrated in FIG. 4, the heat radiation part 18 includes a base 19 and a plurality of fins 21 extending from the base 19 perpendicularly thereto. The ends of the plurality of fins 21 are partially covered with the vent deflector 20. A space surrounded by the base 19 of the heat radiation part 18, two adjacent fins 21, and the vent deflector 20 is formed as a ventilation flue 23.

The base 19 is a rectangular plate-like member attached to the electric component 17 and extending in the Y direction. The fin 21 has a rectangular shape with a longitudinal length equal to the longitudinal length of the base 19. A plurality of the fins 21 is formed in the lateral direction (X direction) of the base 19.

Each of the plurality of fins 21 has a windward end portion 21*c* and a leeward end portion 21*d*. The windward end portion 21*c* is an end located on the windward side in the longitudinal direction. The leeward end portion 21*d* is an end located on the leeward side in the longitudinal direction. The windward end portions 21*c* of the plurality of fins 21 correspond to a windward end portion 18*c* of the heat radiation part 18. The leeward end portions 21*d* of the plurality of fins 21 correspond to the leeward end portion 18*d* of the heat radiation part 18.

The vent deflector 20 includes a flat surface portion 20*a* and an inclined portion 20*b*. The flat surface portion 20*a* is a rectangular plate-like member facing the base 19 and extending in the Y direction, and covers the ends of the plurality of fins 21 except portions thereof located on the leeward side of the heat radiation part 18. The inclined portion 20*b* is a plate-like member connected to the windward side of the flat surface portion 20*a*, and is inclined in the gravity direction (Z direction) with respect to the flat surface portion 20*a*.

The windward end portion of the inclined portion 20*b* corresponds to a windward end portion 20*c* of the vent deflector 20. The leeward end portion of the flat surface portion 20*a* corresponds to a leeward end portion 20*d* of the vent deflector 20. The ventilation flue 23 is formed such that the ventilation flue 23 extends from the rear panel 8 toward the front panel 3. The blower 13 blows air through the ventilation flue 23 in the Y direction. The inclined portion 20*b* of the vent deflector 20 can increase the flow velocity of air with respect to the ventilation flue 23.

The windward end portion 20*c* of the vent deflector 20 is located on the windward side with respect to the windward end portions 21*c* of the plurality of fins 21. A part of the leeward side of the plurality of fins 21 of the heat radiation part 18 is not covered with the vent deflector 20 and is left open.

The windward end portion 18*c* of the heat radiation part 18 (the windward end portion 21*c* of the fin 21) is an inlet 24 for allowing air to flow into the ventilation flue 23. The leeward end portion 18*d* of the heat radiation part 18 (the leeward end portion 21*d* of the fin 21) is an outlet 25*a* for the air to flow out from the ventilation flue 23. The part of the leeward side of the plurality of fins 21, not covered with the vent deflector 20, also forms an outlet 25*b* for the air to flow out from the ventilation flue 23. An outlet 25 includes the outlet 25*a* and the outlet 25*b*. The outlet 25*a* is the leeward end portion of the heat radiation part 18. The outlet 25*b* is formed with the end portions of the plurality of fins 21 not covered with the vent deflector 20.

Figure 5:
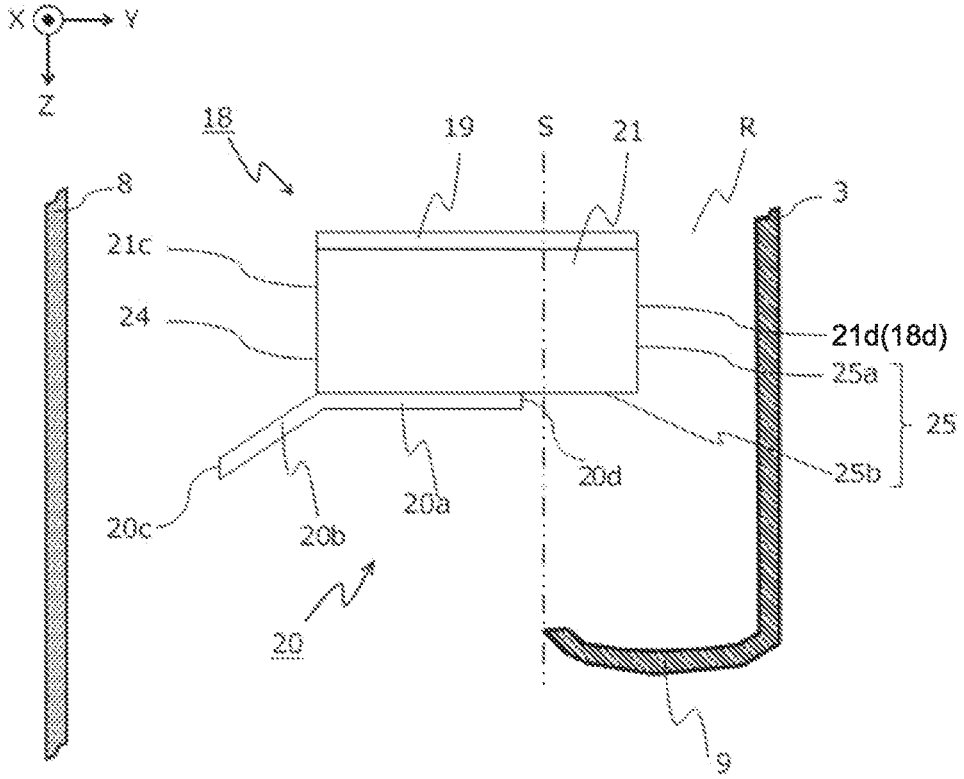
FIG. 5 is an enlarged view of a main part of the outdoor machine according to the first embodiment of the present invention.
Figure 6:
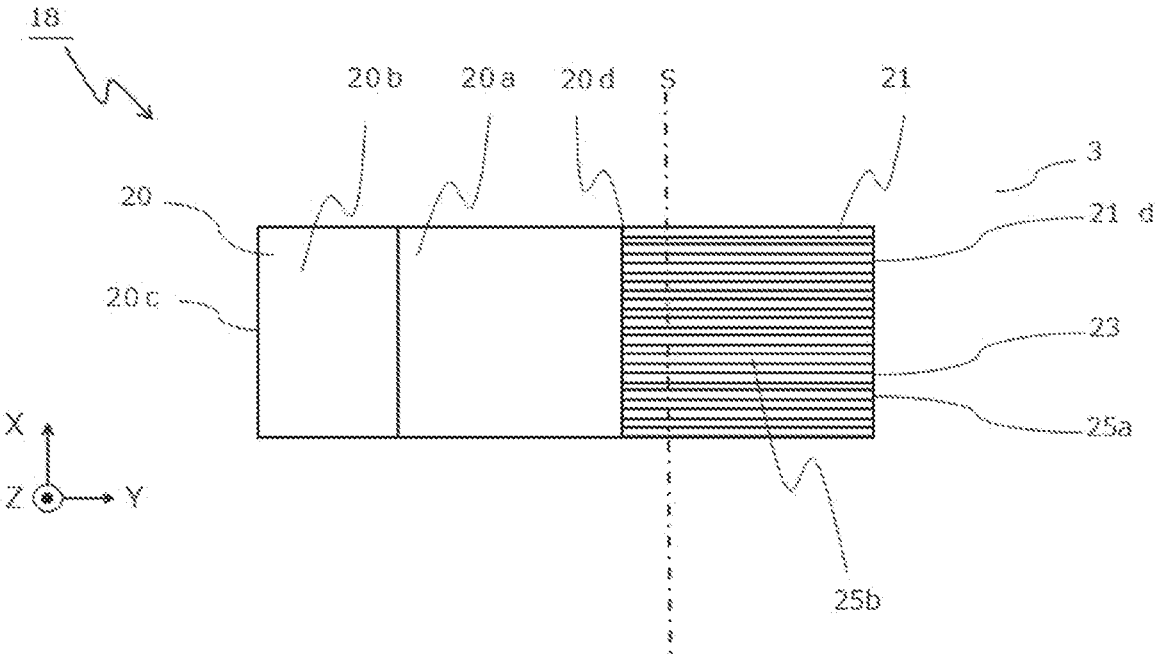
FIG. 6 is an enlarged view of the main part of the outdoor machine according to the first embodiment of the present invention.

As illustrated in FIGS. 5 and 6, the inlet 24 is located on the windward side with respect to the virtual plane S. Furthermore, the outlet 25*a* is located on the leeward side with respect to the virtual plane S, and the outlet 25*b* is formed such that the outlet 25*b* extends from the windward side to the leeward side with respect to the virtual plane S. The opening area of the inlet 24 is equal to the opening area of the outlet 25*a*. Furthermore, the outlet 25 includes the outlet 25*b* in addition to the outlet 25*a* that is equal in opening area to the inlet 24. That is, the opening area of the outlet 25 is larger than the opening area of the inlet 24. Note that hereinafter, the "opening area" may be simply referred to as "area".

In addition, the windward end portion 20*c* of the vent deflector 20 is located on the windward side with respect to the windward end portion 18*c* of the heat radiation part 18. The leeward end portion 20*d* of the vent deflector 20 is located on the windward side with respect to the virtual plane S in the Y direction, and is not located in the region R.

Next, the flow of air in the heat radiation part 18 will be described. Note that in order to facilitate understanding of the effect of the heat radiation part 18, the configuration of a heat radiation part of a comparative example will be described first below. After that, the flow of air in the heat radiation part 18 according to the present embodiment, that is, the first embodiment will be described. Note that when illustrating the comparative example, a constituent element of the comparative example is denoted by a reference numeral obtained as a result of adding "1000" to a reference numeral of a constituent element of the present embodiment, that is, the first embodiment, corresponding to the constituent element of the comparative example.

Comparative Example

The configuration of a heat radiation part 1018 of the comparative example will be described with reference to FIG. 7. The heat radiation part 1018 of the comparative example is different from the heat radiation part 18 according to the present embodiment, that is, the first embodiment in that a vent deflector 1020 fully covers a plurality of fins 1021.

Figure 7:
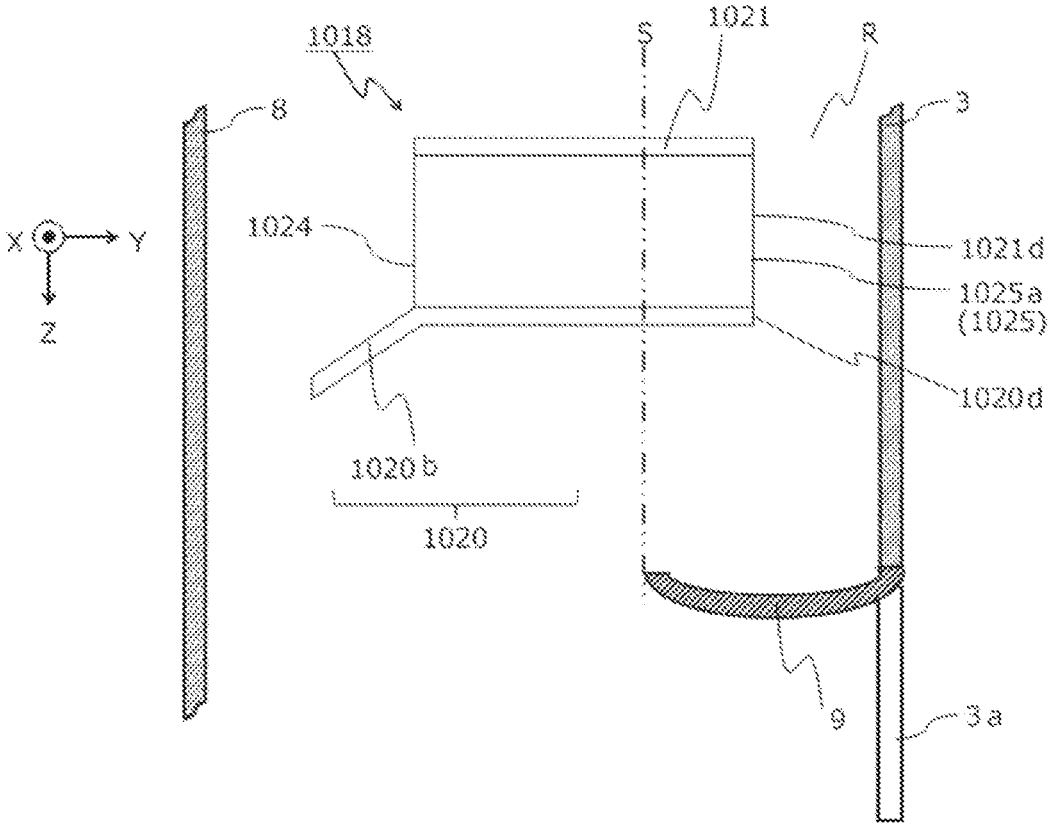
FIG. 7 is an enlarged view of a main part of an outdoor machine according to a comparative example.

As illustrated in FIG. 7, in the heat radiation part 1018 of the comparative example, a leeward end portion 1020*d* of the vent deflector 1020 is located at the same position as leeward end portions 1021*d* of the plurality of fins 1021 in the Y direction. Furthermore, in the heat radiation part 1018, the end side of the plurality of fins 1021 is fully covered with the vent deflector 1020. That is, the heat radiation part 1018 of the comparative example does not have an opening corresponding to the outlet 25*b* formed in the heat radiation part 18 according to the present embodiment, that is, the first embodiment. That is, an outlet 1025 of a ventilation flue 1023 includes only an outlet 1025*a* facing an inlet 1024. Therefore, the area of the outlet 1025 is equal to the area of the inlet 1024.

Next, the flow of air in the heat radiation part 1018 of the comparative example will be described. Air supplied to the heat radiation part 1018 by the blower 13 flows into the ventilation flue 1023 from the inlet 1024. At this time, a part of the air supplied to the heat radiation part 1018 is guided to the inlet 1024 by an inclined portion 1020*b* of the vent deflector 1020. The air that has passed through the ventilation flue 1023 flows out of the ventilation flue 1023 from the outlet 1025 (outlet 1025*a*).

Air that has flowed in from the inlet 1024 of the heat radiation part 1018 flows out from the outlet 1025 toward the front panel 3 of the housing 2. Meanwhile, a space from which the air has flowed out is a closed space surrounded by the front panel 3, the top panel 7, the bell mouth 9 protruding into the housing 2, the partition plate 10 dividing the inside of the housing 2 into the blower chamber 11 and the machine chamber 12, and the outlet 1025 of the heat radiation part 1018. Therefore, the pressure of the closed space is high. Meanwhile, pressure in the heat radiation part 1018, on the outlet 1025 side, is lower than that in the space located on the leeward side with respect to the virtual plane S, in which air flows from the rear panel 8 toward the opening 3*a* provided in the front panel 3. Thus, it becomes difficult for air to flow through the ventilation flue 1023.

Meanwhile, in the heat radiation part 18 according to the present embodiment, that is, the first embodiment, the leeward end portion 20*d* of the vent deflector 20 is located on the windward side with respect to the virtual plane S. As a result, the outlet 25*b* that is exposed without being covered with the vent deflector 20 is formed on the windward side with respect to the virtual plane S and below the ventilation flue 23 in the Z direction, and functions as a part of the outlet 25. The outlet 25*b* communicates with a space that is not blocked by the bell mouth 9 and has a low pressure.

Therefore, air that has passed through the ventilation flue 23 flows out from the outlet 25 (outlet 25*b*) into the space that is not blocked by the bell mouth 9 and has a low pressure. Therefore, the air does not stagnate at the outlet 25, and sufficient air flows through the ventilation flue 23, so that the cooling capacity of the heat radiation part 18 can be improved.

As a result of improving the cooling capacity of the heat radiation part 18, the electric component 17 mounted on the control board 16 can be efficiently cooled to secure the life of the control board 16 and the electric component 17. The electric component 17 is, for example, an electrolytic capacitor. An electrolytic capacitor contains an electrolytic solution, and is thus easily affected by ambient temperature. The life of an electrolytic capacitor is determined by ambient temperature. When the ambient temperature drops by 10 degrees, the life thereof doubles.

Note that it is also conceivable that as a method for improving the flow of air in the ventilation flue, there is adopted a method for eliminating the closed space by making a hole in the front panel to provide an exhaust path through which air flows and is let out of the front panel. However, when a wide-gap semiconductor of GaN, SiC, or the like is mounted on the control board, there is a possibility that radiation noise leaks out of the hole made in the front panel to cause a malfunction of an electrical device adjacent to the outdoor machine. This is because the radiation noise of wide-gap semiconductors is higher than that of conventional semiconductors. Therefore, especially when the wide-gap semiconductor is mounted on the control board, it is not possible to adopt the method for making a hole in the front panel to eliminate the closed space, and it is preferable to adopt the method according to the present invention, for improving the airflow in the ventilation flue without making a hole in the front panel.

Next, a first modified example of the first embodiment will be described with reference to FIGS. 8 and 9. In the first embodiment described above, the heat radiation part 18 has been described in which the leeward end portion 20*d* of the vent deflector 20 is located on the windward side with respect to the virtual plane S. However, as illustrated in FIG. 8, the heat radiation part 18 may be configured such that the vent deflector 20 fully covers the plurality of fins 21, and that an outlet 25*c* as an opening through which the ventilation flue 23 communicates with the outside of the heat radiation part 18 is formed in the flat surface portion 20*a* of the vent deflector 20 in such a way as to be located on the windward side with respect to the virtual plane S.

Figure 8:
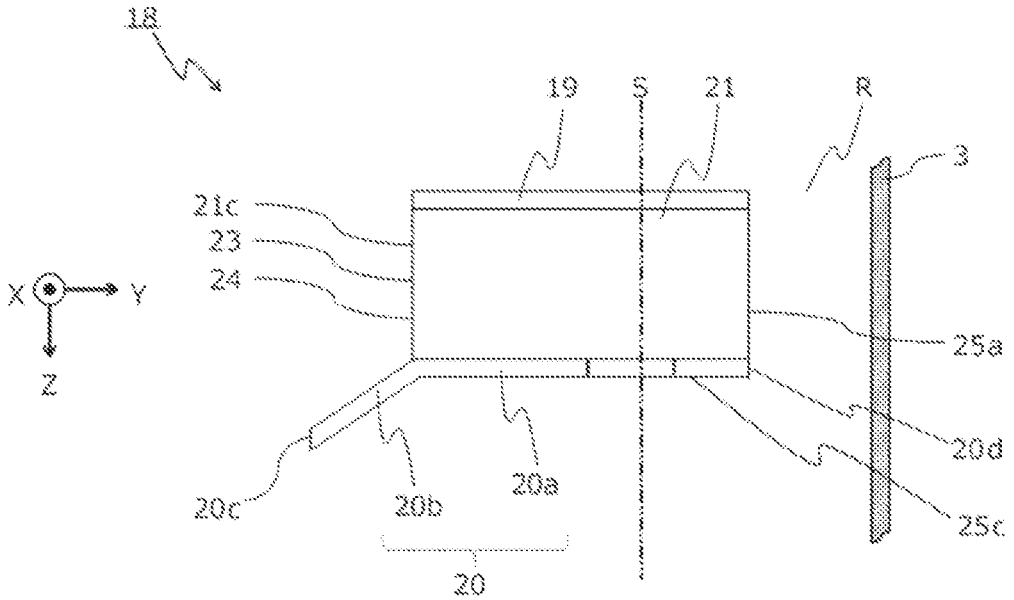
FIG. 8 is an enlarged view of a main part of a first modified example of the outdoor machine according to the first embodiment of the present invention.

FIG. 8 illustrates a side view of the heat radiation part 18 in the first modified example, viewed from the left side panel 4 side of the outdoor machine 1. FIG. 9 illustrates a bottom view of the heat radiation part 18 in the first modified example, viewed from the bottom panel 6 side of the outdoor machine 1.

Figure 9:
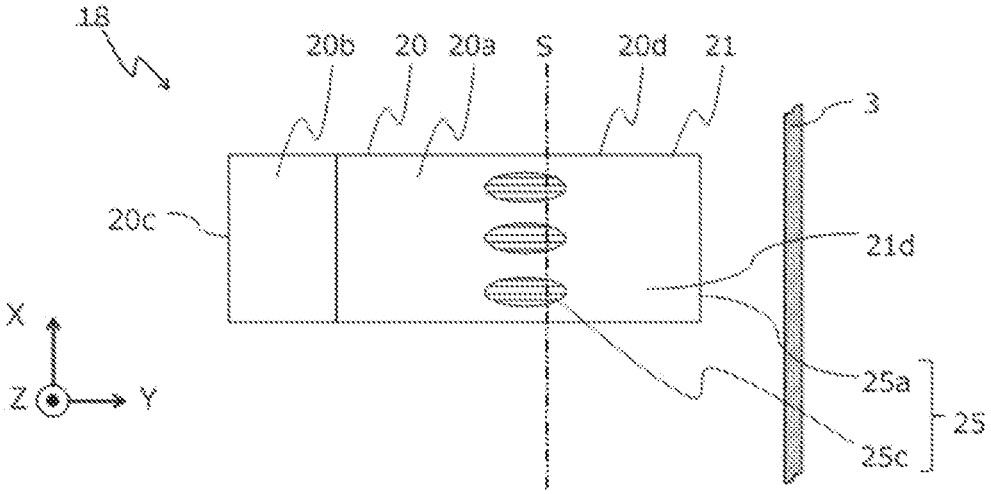
FIG. 9 is an enlarged view of the main part of the first modified example of the outdoor machine according to the first embodiment of the present invention.

As illustrated in FIG. 9, the outlet 25*c* having, for example, a circular shape is formed in the vent deflector 20 of the first modified example. The outlet 25*c* is formed such that the outlet 25*c* extends from the windward side to the leeward side with respect to the virtual plane S. Even in the heat radiation part 18 configured in this manner, the outlet 25 is formed such that the outlet 25 extends toward a space in which pressure loss is smaller than that on the inlet 24 side, the space being located on the windward side with respect to the virtual plane S. Therefore, air can easily flow through the ventilation flue 23, so that the cooling capacity of the heat radiation part 18 can be improved.

Note that the shape of the outlet 25*c* is not limited to a circle, and may be another shape such as a quadrangle or a triangle. Furthermore, the number of the outlets 25*c* may be one or more, and the outlet 25*c* may be opened only on the windward side with respect to the virtual plane S. Moreover, the vent deflector 20 may cover only a part of the heat radiation part 18 while leaving the leeward side of the heat radiation part 18 open.

Second Embodiment

Next, the outdoor machine 1 according to a second embodiment of the present invention will be described with reference to FIGS. 10 and 11. The heat radiation part 18 according to the first embodiment includes the vent deflector 20 including the leeward end portion parallel to the front panel 3 and the leeward end portions of the plurality of fins 21. Meanwhile, the heat radiation part 18 according to the second embodiment includes a vent deflector 30 including a leeward end portion that is not parallel to the front panel 3 or the leeward end portions of the plurality of fins 21. The heat radiation part 18 according to the second embodiment is different from the heat radiation part 18 according to the first embodiment in this respect.

Figure 10:
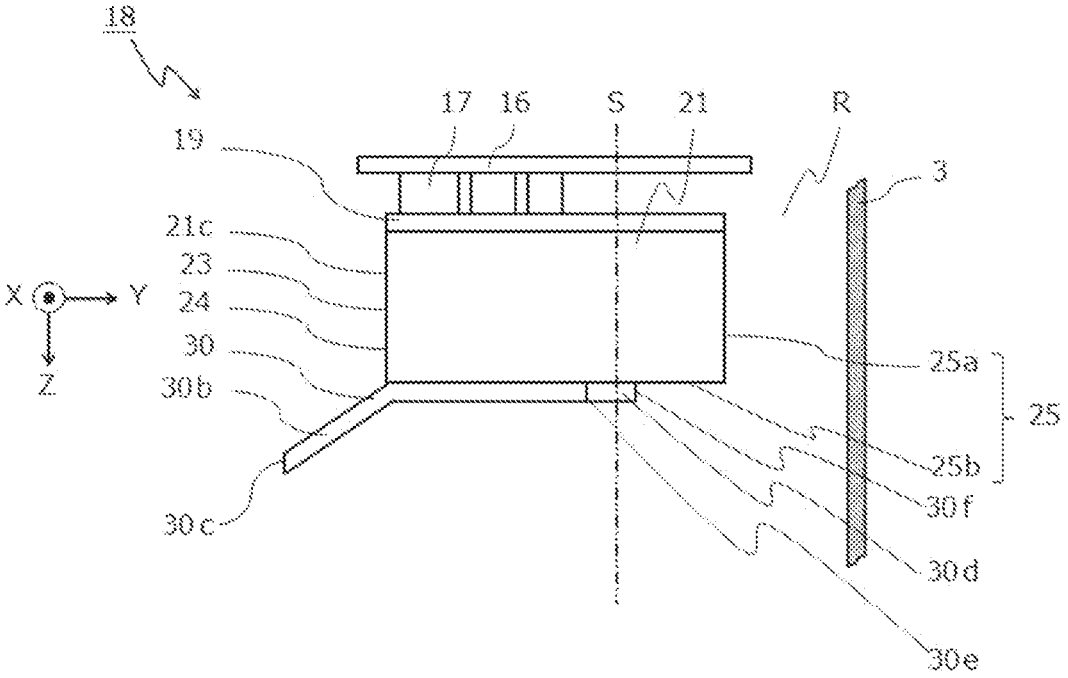
FIG. 10 is an enlarged view of a main part of an outdoor machine according to a second embodiment of the present invention.

FIG. 10 illustrates a side view of the heat radiation part 18 according to the second embodiment, viewed from the left side panel 4 side of the outdoor machine 1. FIG. 11 illustrates a bottom view of the heat radiation part 18 according to the second embodiment, viewed from the bottom panel 6 side of the outdoor machine 1. Hereinafter, unless otherwise specified, the same constituent elements as those in the first embodiment are denoted by the same reference numerals, and description thereof will not be repeated.

As illustrated in FIG. 10, the heat radiation part 18 of the outdoor machine 1 according to the second embodiment includes the vent deflector 30 including a flat surface portion 30*a* with a rectangular shape and an inclined portion 30*b* provided at the longitudinal end of the flat surface portion 30*a*. The inclined portion 30*b* is connected to the windward side of the flat surface portion 30*a*. The flat surface portion 30*a* and the inclined portion 30*b* are integrally formed. The inclined portion 30*b* is inclined with respect to the flat surface portion 30*a* in the gravity direction (Z direction). The flat surface portion 30*a* faces the base 19 in the Z direction. The flat surface portion 30*a* is in contact with the vent deflector side end portions of the plurality of fins 21.

Furthermore, the vent deflector 30 includes a windward end portion 30*c* and a leeward end portion 30*d*. The windward end portion 30*c* is the end of the inclined portion 30*b*. The windward end portion 30*c* is located on the windward side with respect to the windward end portions 21*c* of the plurality of fins 21. The leeward end portion 30*d* is the end of the flat surface portion 30*a*.

Figure 11:
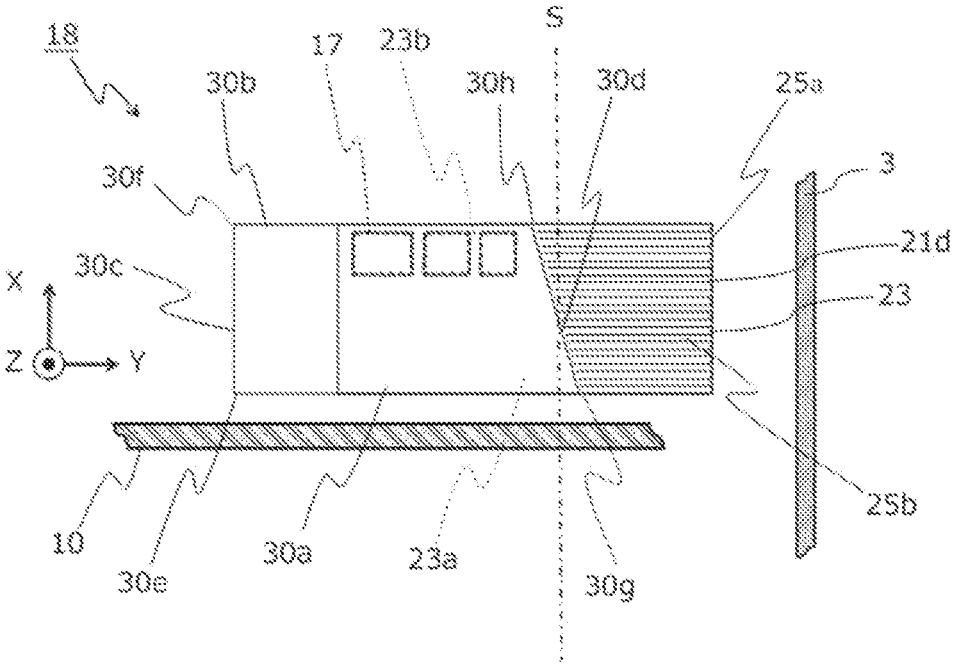
FIG. 11 is an enlarged view of the main part of the outdoor machine according to the second embodiment of the present invention.

Furthermore, as illustrated in FIG. 11, the windward end portion 30*c* of the vent deflector 30 includes a first windward side surface end portion 30*e* and a second windward side surface end portion 30*f* in the X direction. The leeward end portion 30*d* of the vent deflector 30 is formed in a linear shape obliquely to the leeward end portions 21*d* of the plurality of fins 21, and includes a first leeward side surface end portion 30*g* and a second leeward side surface end portion 30*h* in the X direction. The first windward side surface end portion 30*e* and the first leeward side surface end portion 30*g* are ends facing the partition plate 10. The second windward side surface end portion 30*f* and the second leeward side surface end portion 30*h* are ends facing the bell mouth 9.

The distance from the windward end portion 30*c* to the leeward end portion 30*d* of the vent deflector 30 is shortest when measured between the second windward side surface end portion 30*f* and the second leeward side surface end portion 30*h*, and is longest when measured between the first windward side surface end portion 30*e* and the first leeward side surface end portion 30*g*. Thus, the distance from the windward end portion 30*c* to the leeward end portion 30*d* of the vent deflector 30 gets longer as a measuring point on the leeward end portion 30*d* moves from the second leeward side surface end portion 30*h* to the first leeward side surface end portion 30*g*.

Broken lines illustrated in FIG. 11 indicate the positions of the electric components 17 mounted on the control board 16. The electric components 17 are connected to the base 19. The electric components 17 are disposed at an end portion facing the bell mouth 9 in the X direction. Furthermore, the distance between each of the electric components 17 and the second leeward side surface end portion 30*h* is shorter than the distance between each of the electric components 17 and the first leeward side surface end portion 30*g*, in the Y direction. In addition, the distance between the second leeward side surface end portion 30*h* and the inner surface 3*b* of the front panel 3 is longer than the distance between the first leeward side surface end portion 30*g* and the inner surface 3*b* of the front panel 3, in the Y direction.

Moreover, the first leeward side surface end portion 30*g* is located on the leeward side with respect to the virtual plane S, and the second leeward side surface end portion 30*h* is located on the windward side with respect to the virtual plane S. Furthermore, the first leeward side surface end portion 30*g* and the second leeward side surface end portion 30*h* are connected in a straight line. The flat surface portion 30*a* of the vent deflector 30 is formed such that the leeward end portion 30*d* intersects the virtual plane S when viewed from above. That is, a part of the outlet 25 (outlet 25*b*) of the heat radiation part 18 is formed on the windward side with respect to the virtual plane S.

The second leeward side surface end portion 30*h* is located on the windward side with respect to the virtual plane S. Therefore, the outlet of a ventilation flue 23 is located on the windward side with respect to the bell mouth 9, and is opened in a space where air stagnation is less likely to occur and pressure loss is low. Thus, air can easily flow through the ventilation flue 23. As a result, the flow velocity of air flowing through the ventilation flue 23 is increased, so that the cooling capacity of the heat radiation part 18 can be improved.

Furthermore, the leeward end portion 30*d* of the vent deflector 30, formed obliquely to the leeward end portions 21*d* of the plurality of fins 21 includes a plurality of the ventilation flues 23 with different lengths. Among the plurality of ventilation flues 23, a long ventilation flue located on the first leeward side surface end portion 30*g* side is referred to as a first ventilation flue 23*a*, and a short ventilation flue located on the second leeward side surface end portion 30*h* side is referred to as a second ventilation flue 23*b*. Then, the electric components 17 are disposed at positions where the electric components 17 face the second ventilation flue 23*b*.

The flow velocity of air flowing through the ventilation flue 23 decreases as the position of the outlet 25 gets closer to the front panel 3. Therefore, the flow velocity of air in the second ventilation flue 23*b* is higher than the flow velocity thereof in the first ventilation flue 23*a*. The electric components 17 are disposed at the positions where the electric components 17 face the second ventilation flue 23*b*. Therefore, the flow velocity of air flowing through the ventilation flue 23 increases at positions corresponding to the electric components 17. As a result, the electric components 17 can be efficiently cooled.

Therefore, it is possible to efficiently cool the electric components 17 by disposing all the electric components 17 connected to the base 19 on the second leeward side surface end portion 30*h* side. Note that, of the electric components 17, those with higher heat loss may be disposed on the second leeward side surface end portion 30*h* side, and those with lower heat loss may be disposed on the first leeward side surface end portion 30*g* side. As a result of arranging the electric components 17 in this way, the electric components 17 with higher heat loss can be efficiently cooled.

Furthermore, the electric components 17 may be arranged in descending order of heat loss from the windward side toward the leeward side on the second leeward side surface end portion 30*h*. As a result of arranging the electric components 17 in this way, the electric components 17 with higher heat loss can be efficiently cooled.

Figure 12:
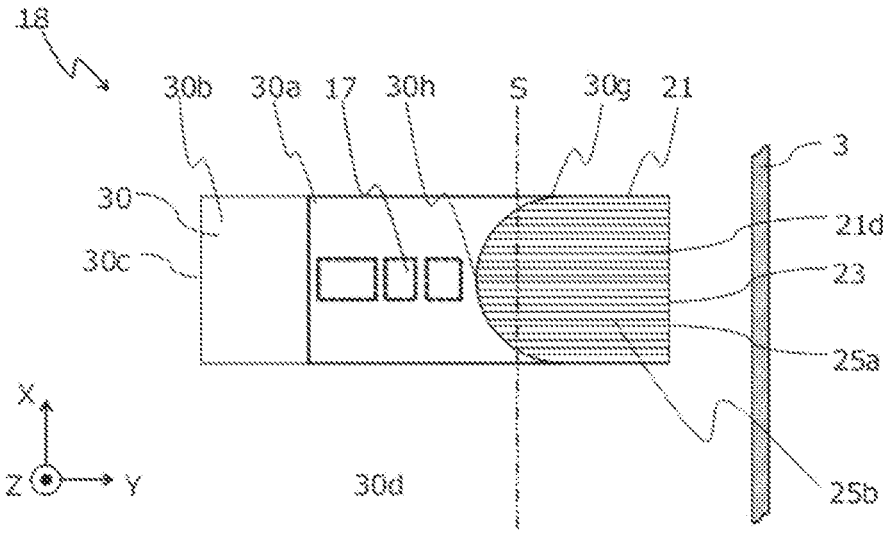
FIG. 12 is an enlarged view of a main part of a first modified example of the outdoor machine according to the second embodiment of the present invention.

Next, a first modified example of the second embodiment will be described. In the second embodiment described above, an example has been described in which the leeward end portion 30*d* of the vent deflector 30 has a linear shape and the vent deflector 30 has a trapezoidal shape when viewed from above. However, as illustrated in FIG. 12, the leeward end portion 30*d* of the vent deflector 30 may have an arc shape. FIG. 12 illustrates a bottom view of the heat radiation part 18 according to the first modified example of the second embodiment as viewed from the bottom panel 6 side of the outdoor machine 1.

As illustrated in FIG. 12, the first leeward side surface end portions 30*g* of the vent deflector 30 are located at both ends of the leeward end portion 30*d* in the X direction. Furthermore, the second leeward side surface end portion 30*h* of the vent deflector 30 is located at the center of the leeward end portion 30*d* in the X direction. Moreover, the first leeward side surface end portions 30*g* and the second leeward side surface end portion 30*h* are connected in an arc shape. The electric components 17 are disposed on the second leeward side surface end portion 30*h* side in the X direction. Furthermore, the electric components 17 are arranged on a straight line that passes through the second leeward side surface end portion 30*h* and is parallel to the Y direction when viewed from above.

Next, a second modified example of the second embodiment will be described. In the second embodiment described above, an example has been described in which the leeward end portion 30*d* of the vent deflector 30 has a linear shape and the vent deflector 30 has a trapezoidal shape when viewed from above. However, as illustrated in FIG. 13, the leeward end portion 30*d* of the vent deflector 30 may be L-shaped.

Figure 13:
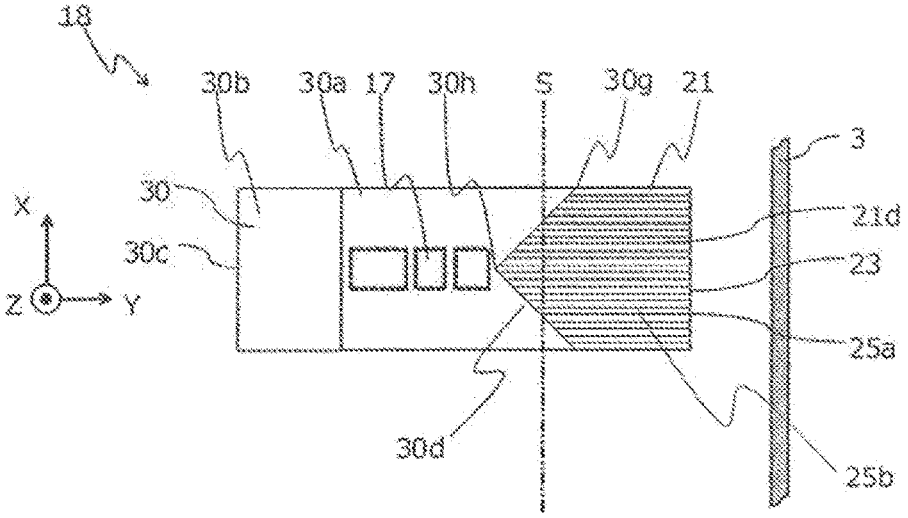
FIG. 13 is an enlarged view of a main part of a second modified example of the outdoor machine according to the second embodiment of the present invention.

As illustrated in FIG. 13, the first leeward side surface end portions 30*g* of the vent deflector 30 are located at both ends of the leeward end portion 30*d* in the X direction. Furthermore, the second leeward side surface end portion 30*h* of the vent deflector 30 is located at the center of the leeward end portion 30*d* in the X direction. Furthermore, the first leeward side surface end portion 30*g* and the second leeward side surface end portion 30*h* are connected in a straight line. The electric components 17 are disposed on the second leeward side surface end portion 30*h* side in the X direction. In addition, the electric components 17 are arranged on a straight line that passes through the second leeward side surface end portion 30*h* and is parallel to the Y direction when viewed from above.

Also in the heat radiation part 18 of each of the first and second modified examples of the second embodiment, the flow velocity of air flowing through the ventilation flue 23 corresponding to the second leeward side surface end portion 30*h* increases. Thus, the electric components 17 disposed on the second leeward side surface end portion 30*h* side can be efficiently cooled. Furthermore, as a result of disposing the electric components 17 in the center of the heat radiation part 18 in the X direction, heat generated in the electric components 17 is easily transferred to the entire heat radiation part 18, so that the electric components 17 can be efficiently cooled.

Note that in the second embodiment described above, an example has been described in which the first leeward side surface end portion 30*g* of the vent deflector 30 is located on the leeward side with respect to the virtual plane S, but the first leeward side surface end portion 30*g* may be located on the windward side with respect to the virtual plane S. With such a configuration, the area of the outlet 25*b* further increases, so that air easily flows into a space where pressure loss is smaller. Thus, air easily flows through the ventilation flue 23.

Third Embodiment

Next, the outdoor machine 1 according to a third embodiment of the present invention will be described with reference to FIG. 14 In the heat radiation part 18 according to the first embodiment, the leeward end portion 18*d* is located on the leeward side with respect to the virtual plane S. Meanwhile, a heat radiation part 180 according to the third embodiment includes a leeward end portion 180*d* located on the windward side with respect to the virtual plane S. The heat radiation part 180 according to the third embodiment is different from the heat radiation part 18 according to the first embodiment in this respect.

Figure 14:
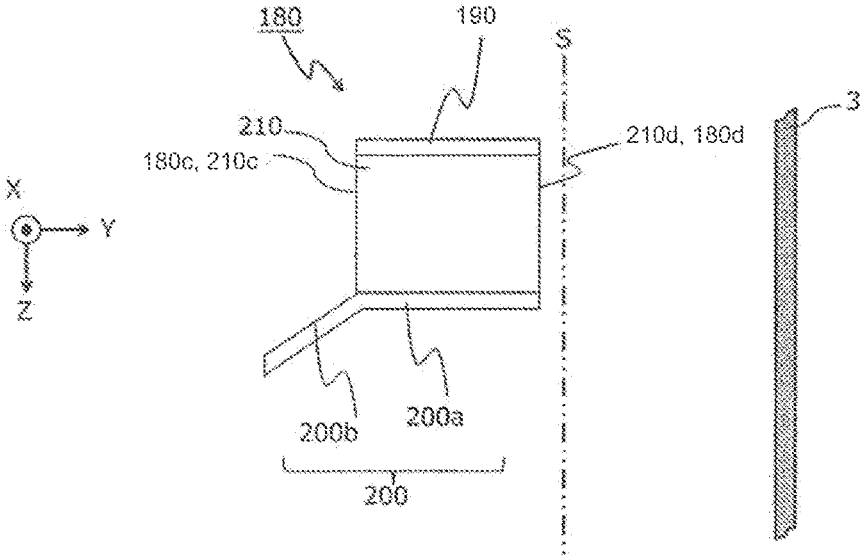
FIG. 14 is an enlarged view of a main part of an outdoor machine according to a third embodiment of the present invention.

FIG. 14 illustrates a side view of the heat radiation part 180 according to the third embodiment, viewed from the left side panel 4 side of the outdoor machine 1. Hereinafter, unless otherwise specified, the same constituent elements as those in the first embodiment are denoted by the same reference numerals, and description thereof will not be repeated.

As illustrated in FIG. 14, the heat radiation part 180 of the outdoor machine 1 according to the third embodiment includes a base 190 and a plurality of fins 210 extending from the base 190 perpendicularly thereto. The ends of the plurality of fins 210 are partially covered with a vent deflector 200. A space surrounded by the base 190 of the heat radiation part 180, two adjacent fins 210, and the vent deflector 200 is formed as a ventilation flue 230.

The base 190 is a rectangular plate-like member attached to the electric component 17 and extending in the Y direction. The fin 210 has a rectangular shape with a longitudinal length equal to the longitudinal length of the base 190. A plurality of the fins 210 is formed in the lateral direction (X direction) of the base 190.

Each of the plurality of fins 210 has a windward end portion 210*c* and a leeward end portion 210*d*. The windward end portion 210*c* is an end located on the windward side in the longitudinal direction. The leeward end portion 210*d* is an end located on the leeward side in the longitudinal direction. The windward end portions 210*c* of the plurality of fins 210 correspond to a windward end portion 180*c* of the heat radiation part 180. The leeward end portions 210*d* of the plurality of fins 210 correspond to the leeward end portion 180*d* of the heat radiation part 180.

The vent deflector 200 includes a flat surface portion 200*a* and an inclined portion 200*b* provided at the longitudinal end of the flat surface portion 200*a*. The inclined portion 200*b* is connected to the windward side of the flat surface portion 200*a*. The flat surface portion 200*a* and the inclined portion 200*b* are integrally formed. The inclined portion 200*b* is inclined with respect to the flat surface portion 200*a* in the gravity direction (Z direction). The flat surface portion 200*a* faces the base 190 in the Z direction.

The vent deflector 200 includes a windward end portion 200*c* and a leeward end portion 200*d*. The windward end portion 200*c* is the end of the inclined portion 200*b*. The windward end portion 200*c* is located on the windward side with respect to the windward end portions 210*c* of the plurality of fins 21. The leeward end portion 200*d* is the end of the flat surface portion 200*a*.

As illustrated in FIG. 14, the leeward end portion 180*d* of the heat radiation part 180 and the vent deflector 200 are located on the windward side with respect to the virtual plane S. Thus, the heat radiation part 180 and the vent deflector 200 are not disposed in the region R that is a region between the virtual plane S and the front panel 3.

Therefore, air that has passed through the ventilation flue 230 flows out at a position on the windward side with respect to the virtual plane S. Thus, sufficient air flows through the ventilation flue 230 without stagnating at the outlet, so that the cooling capacity of the heat radiation part 180 can be improved.

Furthermore, it is possible to cause air to more easily flow through the ventilation flue 230 and further improve the cooling capacity of the heat radiation part 180 by configuring the windward end portion of the heat radiation part such that a part of the windward end portion is not covered with the vent deflector and providing a second outlet, as set forth in the first and second embodiments.

Note that FIG. 14 illustrates a configuration in which the length of the heat radiation part 180 in the Y-axis direction is equal to the length of the vent deflector 200 in the Y-axis direction. However, it is possible to further increase flow velocity and improve cooling capacity by causing the vent deflector 200 to be smaller in length than the heat radiation part 180 in the Y-axis direction and forming an outlet with, for example, a circular shape in the vent deflector 200, as set forth in the first embodiment.

Furthermore, similarly, it is possible to cause flow velocity to increase as the distance from the windward end portion 200*c* to the leeward end portion 200*d* of the vent deflector 200 decreases and to improve cooling capacity by forming the leeward end portion 200*d* of the vent deflector 200 obliquely to the leeward end portion 210*d* or forming the leeward end portion 200*d* in an arc shape or an L shape as set forth in the second embodiment. That is, it is also possible to implement a configuration in which the above-described embodiments are appropriately combined.

In the first to third embodiments described above, examples have been described in which the plurality of fins 21 and 210 includes plate-like members. However, the shape of the plurality of fins 21 and 210 is not limited thereto. For example, another shape such as a rod-like shape may be adopted.

Furthermore, in the first to third embodiments described above, examples of horizontal placement in which the control board 16 is horizontally placed have been described. However, the control board 16 may be vertically placed in the gravity direction (Z direction). In that case, the plurality of fins 21, 210 extends in the horizontal direction, and the flat surface portions 20*a*, 30*a*, and 200*a* of the vent deflectors 20, 30, and 200 are disposed in such a way as to extend along the Z direction.

Furthermore, in the first to third embodiments described above, examples have been described in which the flat surface portions 20*a*, 30*a*, and 200*a* of the vent deflectors 20, 30, and 200 are connected to the vent deflector side end portions of the plurality of fins 21 and 210. However, there may be a gap between the flat surface portions 20*a*, 30*a*, and 200*a* and the vent deflector side end portions.

Furthermore, in the first to third embodiments described above, examples in which the vent deflectors 20, 30, and 200 respectively include the inclined portions 20*b*, 30*b*, and 200*b* have been described. However, the vent deflectors 20, 30, and 200 may be configured such that the vent deflectors 20, 30, and 200 do not include the inclined portion 20*b*, 30*b*, or 200*b* and that the entire vent deflectors 20, 30, and 200 are formed in a planar shape. In this case, the windward end portions of the flat surface portions 20*a*, 30*a*, and 200*a* serve as the windward end portions 20*c*, 30*c*, and 200*c* of the vent deflectors 20, 30, and 200, respectively. At this time, the windward end portions 20*c*, 30*c*, and 200*c* of the vent deflectors 20, 30, and 200 may be disposed at the same positions in the Y direction as the windward end portions 21*c* and 210*c* of the plurality of fins 21 and 210.

Furthermore, in the first to third embodiments described above, examples have been provided in which the bases 19 and 190 are respectively equal in longitudinal length to the fins 21 and 210. However, the plurality of fins 21 and 210 may be configured such that the plurality of fins 21 and 210 is smaller in longitudinal length than the bases 19 and 190, and is provided on the upstream ends or downstream ends of the bases 19 and 190, respectively, so that only the leeward side or windward side is opened.

Note that the outdoor machine 1 according to any of the first to third embodiments described above may be applied to an outdoor machine of a heat pump water heater.

The invention claimed is:

1. An outdoor machine comprising:

a housing that includes a front panel in which an outlet of an air current is formed;

a blower that is provided inside the housing and generates the air current;

a compressor provided inside the housing;

a partition plate that divides a space inside the housing into a compressor chamber in which the compressor is stored and a blower chamber in which the blower is stored;

a bell mouth disposed in an outer periphery of the blower in such a way as to be connected to the outlet, the bell mouth having an edge protruding into the housing;

a control board on which an electric component is mounted, the control board being provided inside the housing;

a heat radiation part that radiates heat generated by the electric component, the heat radiation part being provided in the blower chamber; and a vent deflector that covers the heat radiation part, and forms a ventilation flue through which the air current flows, wherein an end of the heat radiation part on a side facing the front panel is located in a region between a virtual plane and the front panel, the virtual plane covering an entire periphery of the edge of the bell mouth and extending in parallel with the front panel, and when viewed from front, the heat radiation part is disposed adjacent to the edge of the bell mouth such that the heat radiation part is located outside the edge of the bell mouth, the vent deflector is not provided in the region between the virtual plane and the front panel, the ventilation flue includes a first ventilation flue and a second ventilation flue, and a distance from an inlet to an outlet of the first ventilation flue is longer than a distance from an inlet to an outlet of the second ventilation flue.

2. The outdoor machine according to claim 1, wherein the housing includes a rear panel facing the front panel, the ventilation flue of the heat radiation part is formed such that the ventilation flue extends from the rear panel toward the front panel, an inlet of the ventilation flue is provided on a rear panel side with respect to the virtual plane, and an outlet of the ventilation flue is provided on a front panel side with respect to the virtual plane.

3. The outdoor machine according to claim 1, wherein the housing includes a rear panel facing the front panel, the ventilation flue of the heat radiation part is formed such that the ventilation flue extends from the rear panel toward the front panel, and an inlet and an outlet of the ventilation flue are provided on a rear panel side with respect to the virtual plane.

4. The outdoor machine according to claim 1, wherein the electric component is disposed at a position where the electric component faces the second ventilation flue.

5. The outdoor machine according to claim 1, wherein a length of the first ventilation flue and a length of the second ventilation flue differ according to a length of the vent deflector, and a leeward end portion of the vent deflector is formed obliquely to the front panel.

6. The outdoor machine according to claim 1, wherein a length of the first ventilation flue and a length of the second ventilation flue differ according to a length of the vent deflector, and a leeward end portion of the vent deflector is formed in an arc shape.

7. The outdoor machine according to claim 5, wherein the second ventilation flue is provided closer to the bell mouth than the first ventilation flue when viewed from above.

8. The outdoor machine according to claim 1, wherein a wide-gap semiconductor is mounted on the control board.

9. An air conditioner comprising:

the outdoor machine according to claim 1.

* * * * *